United States Patent [19]

Koenig

[11] Patent Number: 4,639,946

[45] Date of Patent: Feb. 3, 1987

[54] RESTRAINING GARMENT WITH DETACHABLE BIB

[76] Inventor: Linda S. Koenig, 1014 S. Euclid St., Santa Ana, Calif. 92704

[21] Appl. No.: 783,612

[22] Filed: Oct. 3, 1985

[51] Int. Cl.[4] ..... A41B 13/10

[52] U.S. Cl. ..... 2/49 R; 2/DIG. 6

[58] Field of Search ..... 2/DIG. 6, 49 R

[56] References Cited

U.S. PATENT DOCUMENTS

| | | | |
|---|---|---|---|
| 2,448,076 | 8/1948 | Bradley | 2/49 R |
| 2,449,741 | 9/1948 | Fitzpatrick | 2/49 R |
| 2,954,563 | 10/1960 | De Grazia | 2/DIG. 6 |
| 3,871,027 | 3/1975 | Orr | 2/49 R |
| 4,301,544 | 11/1981 | Burton | 2/49 R |
| 4,497,069 | 2/1985 | Braunhut | 2/DIG. 6 |

*Primary Examiner*—Louis K. Rimrodt

*Attorney, Agent, or Firm*—Herbert E. Haynes, Jr.

[57] ABSTRACT

A garment for restrainingly holding a baby in a high chair includes a vest-like torso covering vestment which opens in the back and is detachably connected to the seat and back rest portions of the high chair by straps which are detachably connected to each other by quick release fasteners. The garment further includes a bib detachably carried on the front of the torso covering vestment for facilitating clean up subsequent to feeding of the baby.

10 Claims, 3 Drawing Figures

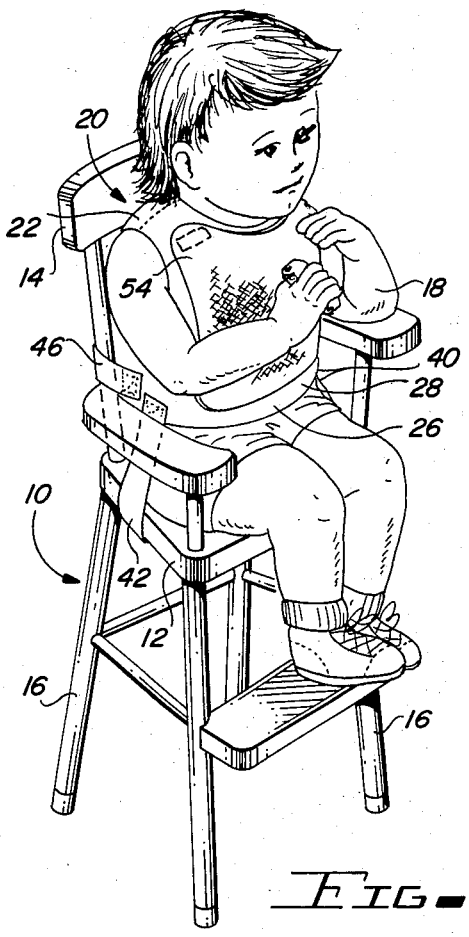
FIG-1
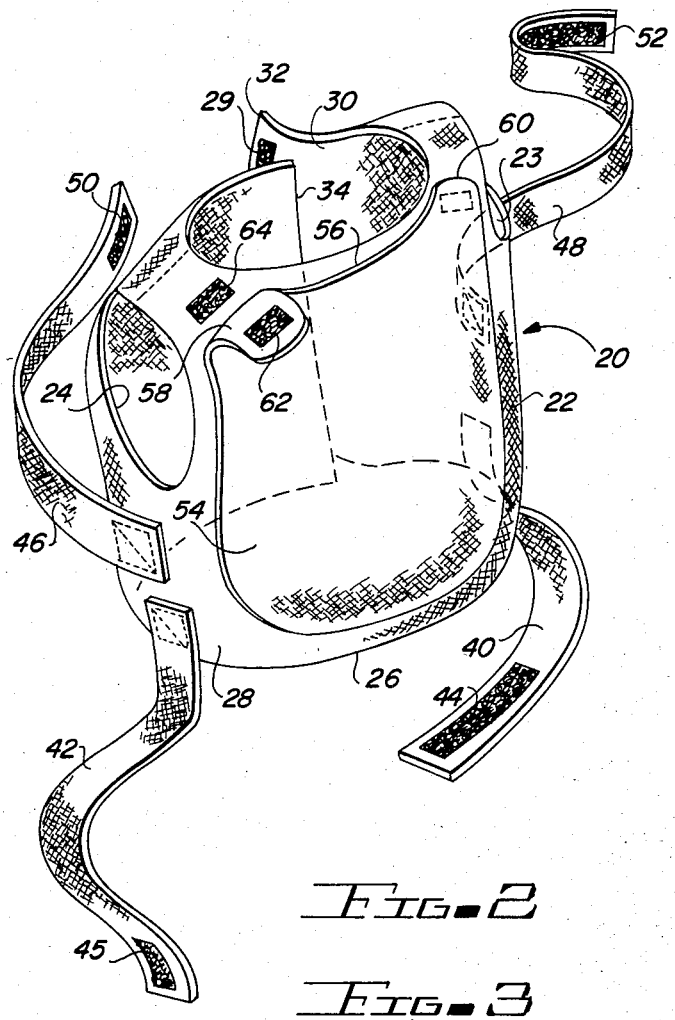
FIG-2
FIG-3
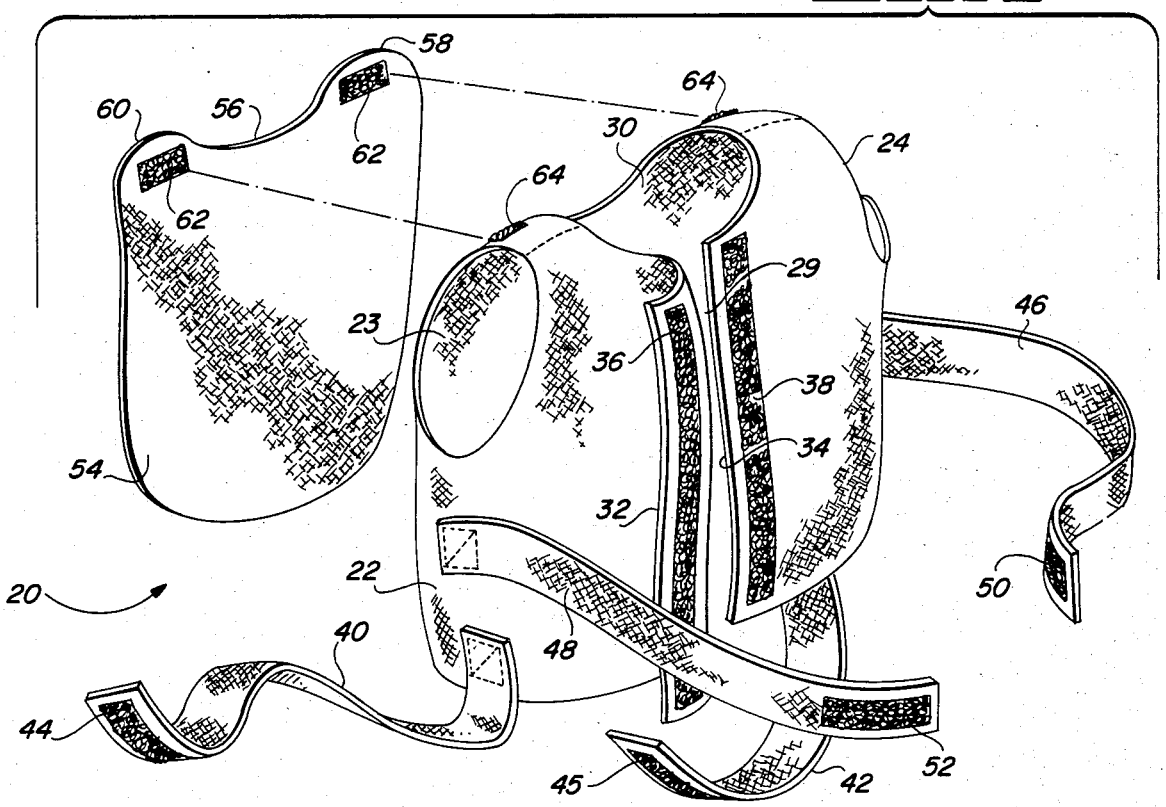

RESTRAINING GARMENT WITH DETACHABLE BIB

BACKGROUND OF THE INVENTION

1. Field of the Invention

This invention relates in general to garments and more particularly to a garment for restrainingly securing a baby in a high chair or the like, with the garment being provided with a detachable bib.

2. Description of the Prior Art

A particular problem relating to child safety is the use of high chairs of the type commonly used for feeding a baby. When a baby is ready for solid food, the baby is seated in the high chair to facilitate such feeding and this is always of concern in that babies at that young age are very active and virtually unable to sit still. Even though most high chairs are provided with a tray which restrains a baby to a limited extent, constant surveillance is the only way to positively prevent the baby from falling out of the high chair or otherwise hurting himself or herself. In the beginning when the baby is being fed by one of the parents, or other adult, the surveillance is pretty constant. But, even during this early stage of baby feeding the adult must interrupt surveillance from time to time and many babies are hurt during those periods of interrupted surveillance.

When the baby begins to learn how to feed himself or herself, surveillance usually decreases as the learning process progresses, but the dangers associated with high chairs remains.

As a result of these well known dangers, several baby restraining garments have been devised, however, none of these garments has, to the best of my knowledge, achieved any significant degree of commercial success.

Examples of such prior art baby restraining garments are fully disclosed in U.S. Pat. Nos. 2,077,244 issued to M. R. LeRoy on Apr. 13, 1937, 2,170,703, issued to C. F. Waxman et al on Aug. 22, 1939, and 2,448,076 issued to R. I. Bradley on Aug. 31, 1948.

It is believed that the lack of appreciable commercial success of these prior art garments is due, at least in part, to the difficulty in using such garments. More specifically, the LeRoy garment has four depending straps which are wound around the legs of the high chair below the seat and tied together in bows. The Waxman et al garment has a total of seven straps which are individually connected to different locations on the high chair. The Bradley garment requires that the baby be laced into the garment and the laces connected to the high chair below the seat thereof.

As well known, feeding a baby can, and often is, a messy operation when becomes more messy when the baby begins feeding himself or herself. All of the prior art garments referred to above suggest that the garments will serve as bibs in addition to their restraining function. Due to the messy nature of a baby feeding operation, these prior art garments must be washed very often, sometimes as often as after each meal. This, obviously can become a very tiresome and time consuming chore.

Therefore, a need exists for a new and improved baby restraining garment with detachable bib which overcomes some of the problems and shortcomings of the prior art.

SUMMARY OF THE INVENTION

In accordance with the present invention, a new and improved garment with detachable bib is disclosed for restraining a baby in a high chair. The garment is of vest-like configuration having a placket, or opening, down the back which is defined by cofacing edges which are secured to each other in an overlapped manner. A first pair of straps depend from opposite sides of the bottom edge of the garment and are for connection to each other under the seat of the high chair to restrainingly hold the baby to the seat portion of the high chair; a second pair of straps extend rearwardly from opposite sides of the garment from below the arm holes thereof. These second straps are for connection to each other behind the back rest portion of the high chair to restrainingly hold the baby against the back rest.

The ends of each of the straps of both the first and second pairs of straps and the edges which define the back placket are provided with cooperating elements of interconnecting fasteners such as Velcro, or other quick connect fasteners such as snaps. In this manner, the garment is simple to put on the baby and simple to connect to the high chair. Further, the garment comfortably restrains the baby against excessive vertical and horizontal movements.

In addition to the above, the garment is provided with a bib which is detachably secured to the front of the garment to facilitate the clean-up chore which almost inevitably follows each feeding of the baby. Quick connect fasteners, such as Velcro are provided on the garment, such as in both of the shoulder, or upper breast areas thereof, and mating fasteners are provided on the upper part of the bib. In this way, only the bib needs to be laundered subsequent to each feeding and even that chore can be minimized by providing plural bibs for use with the garment.

Accordingly, it is an object of the present invention to provide a new and improved garment for restraining a baby while seated in a high chair or other type of chair.

Another object of the present invention is to provide a new and improved baby restraining garment which is simple to put on a baby and is simple to connect to the chair.

Another object of the present invention is to provide a new and improved baby restraining garment which is particularly well suited for restrainingly holding a baby in a high chair during feeding of the baby with the garment being provided with a detachable bib to facilitate subsequent clean-up.

The foregoing and other objects of the present invention as well as the invention itself may be more fully understood from the following description when read in conjunction with the accompanying drawings.

BRIEF DESCRIPTION OF THE DRAWINGS

FIG. 1 is a perspective view of a typical high chair with a baby being restrainingly held therein by the garment of the present invention.

FIG. 2 is a perspective front view of the garment of the present invention illustrating the various features thereof.

FIG. 3 is a perspective back view of the garment of the present invention with the detachable bib portion thereof being shown in an exploded relationship therewith.

DESCRIPTION OF THE PREFERRED EMBODIMENT

Referring more particularly to the drawings, FIG. 1 shows a typical high chair 10 which includes the usual seat portion 12, back rest portion 14 and supporting legs 16. Chairs of this general type are normally provided with a detachable tray structure which is omitted from the drawing for clarity.

FIG. 1 further shows a baby 18 which is restrainingly held in the high chair by the restraining garment of the present invention with the restraining garment being indicated in its entirety by the reference numeral 20.

The garment 20 includes a torso covering means 22, formed of any suitable fabric or similar material, in the preferred form of a vest-like garment which has arm openings 23 and 24 on the opposite sides thereof and which covers the baby's shoulders and extends downwardly to cover the baby's torso and has a bottom edge 26 which is located at approximately the waist of the baby as shown in FIG. 1. The torso covering means 22 has a smooth uninterrupted front portion 28 and a placket, or opening, 29 extending downwardly from the neck opening 30 through the bottom edge 26 thereof. The placket 29 is defined by cofacing edges 32 and 34 of the garment and those edges are intended to be overlappingly and detachably secured to each other subsequent to placement of the garment on the baby. It is preferred that the attachment of the overlapping edges 32 and 34 to each other be accomplished by the cooperating strips of interconnectable hooks and eyelets 36 and 38 of the type commonly referred to as Velcro fasteners. It will be understood that this objective could be accomplished by using other simple and quick release fasteners such as snaps (not shown).

The garment 20 further includes a first pair of elongated straps 40 and 42 which are sewn or otherwise attached to the torso covering means 22 so as to depend from the bottom edge 26 thereof at different and opposed sides of the torso covering means. Those straps 40 and 42 are, as indicated in FIG. 1, for looped placement beneath the seat portion 12 of the high chair 10 and are provided with means for overlappingly and detachably connecting the ends of those straps to each other such as by means of the cooperating strips of hooks and eyelets 44 and 45 of a Velcro type fastener, or other suitable fasteners.

The garment 20 further includes a second pair of elongated straps 46 and 48 which are sewn or otherwise attached to the torso covering means 22 so as to extend rearwardly from the torso covering means from below different ones of the arm openings 23 and 24 thereof. These rearwardly extending straps 46 and 48 are intended to be looped around the back rest portion 14 of the high chair and overlappingly and detachably attached to each other by means of the cooperating strips of hooks and eyelets 50 and 52 of the illustrated Velcro fastener, or equivalent quick release fasteners, as discussed above.

From the above, it will be apparent that the restraining garment 20 is configured to be simple and easy to put on a baby and to connect to the high chair 10 and will comfortably and positively restrain a baby against excessive movements both vertically and horizontally.

In addition, the restraining garment 20 is provided with a detachable bib 54 which is preferably formed of a sheet of fabric, or similar material, and cut or otherwise formed with a neck receiving recess 56. By forming the neck recess 56 as described above, the bib 54 is provided with shoulder flaps 58 and 60 which extend upwardly from the bib on opposite sides of the neck receiving recess 56.

When the bib 54 is detachably placed on the smooth uninterrupted front 28 of the torso covering means 22 of the garment 20, the neck receiving recess 56 is more or less concentric with the neck opening 30 and the flaps 58 and 60 are in overlaying position with the shoulder portions of the torso covering means as seen best in FIG. 2. Therefore, the bib 54 will overlay the major portions of the front 28 of the garment 20 and thereby shield the front against soiling during feeding of the baby.

Detachable connection of the bib 54 to the torso covering means 22 of the garment 20 may be accomplished by providing cooperating strips of hooks and eyelets 62 and 64 of a pair of Velcro type fasteners on the shoulder areas of the torso covering means 22 and on the shoulder flaps 58 and 60 of the bib 54. As mentioned above other quick release fasteners could be used for this purposes such as snaps (not shown).

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A garment for restrainingly holding a baby in a sitting position in a chair having a seat portion and a back rest portion, said garment comprising:

(a) a torso covering means;

(b) a first pair of elongated straps depending from opposite sides of said torso covering means for looped placement beneath the seat portion of the chair in which the baby is to be restrained;

(c) fastener means on the extending ends of said first pair of straps for detachably connecting said first pair of straps to each other beneath the seat portion of the chair;

(d) a second pair of elongated straps extending rearwardly from opposite sides of said torso covering means for looped around placement in back of the back rest portion of the chair in which the baby is to be restrained;

(e) fastener means on the extending ends of said second pair of straps for detachably connecting said second pair of straps to each other in back of the back rest portion of the chair; and (f) a bib detachably mounted on said torso covering means.

2. A garment as claimed in claim 1 wherein said fastener means on the extending ends of said first and said second pairs of straps are quick release interconnecting strips of hooks and eyelets.

3. A garment as claimed in claim 1 wherein said torso covering means is of vest-like configuration having arm openings, a substantially uninterrupted front portion and a placket extending down the back with the placket being defined by cofacing edges.

4. A garment as claimed in claim 3 and further comprising quick release strips of interconnecting hooks and eyelets and the cofacing edges of said torso covering means for detachably connecting the cofacing edges to each other.

5. A garment as claimed in claim 3 wherein said bib is detachably mounted on the uninterrupted front portion of said torso covering means.

6. A garment as claimed in claim 5 wherein the detachable mounting of said bib is accomplished by quick release interconnecting strips of hooks and eyelets provided on the uninterrupted front portion of said torso covering means and on said bib.

7. A garment for restraining a baby in a sitting position in a high chair having a seat portion and a back rest portion, said garment comprising:

(a) a torso covering means of vest-like configuration having an opposed pair of arm receiving openings, a substantially uninterrupted front portion and a placket extending down the back with the placket being defined by a pair of cofacing edges;

(b) fastener means on the cofacing edges of said torso covering means for detachable connection thereof to each other;

(c) a first pair of elongated straps each attached to said torso covering means below a different one of the arm receiving openings thereof and extending rearwardly therefrom for looped around placement in back of the back rest portion of the high chair;

(d) fastener means on the extending ends of said first pair of straps for detachable connection thereof to each other;

(e) a second pair of elongated straps attached on opposite sides of said torso covering means at locations below the attachment points of said first pair of straps, said second pair of straps depending from said torso covering means for looped placement below the seat portion of the high chair;

(f) fastener means on the extending ends of said second pair of straps for detachable connection thereof to each other;

(g) a bib; and (h) fastener means on the uninterrupted front of said torso covering means and on said big for detachably connecting said bid to the uninterrupted front of said torso covering means.

8. A garment as claimed in claim 7 wherein said fastener means on the cofacing edges of said torso covering means comprises quick release interconnecting strips of hooks and eyelets.

9. A garment as claimed in claim 7 wherein said fastener means on the extending ends of said first pair of straps and on the extending ends of said second pair of straps comprises quick release interconnecting strips of hooks and eyelets.

10. A garment as claimed in claim 7 and further comprising:

(a) said bib being formed of a sheet of fabric material defining an upper edge having a neck receiving recess formed centrally therein and a pair of shoulder flaps on opposite sides of the neck receiving recess; and (b) said fastener means on the uninterrupted front of said torso covering means and on said bib includes quick release interconnecting strips of hooks and eyelets on the shoulder flaps of said bib and in mating positions on the upper part of the uninterrupted front portion of said torso covering means for detachably connecting said bib to said torso covering means.

* * * * *